US011148424B2

(12) United States Patent
Suzuki et al.

(10) Patent No.: US 11,148,424 B2
(45) Date of Patent: Oct. 19, 2021

(54) PRINTING APPARATUS AND INK REPLENISHMENT METHOD

(71) Applicant: SCREEN HOLDINGS CO., LTD., Kyoto (JP)

(72) Inventors: Yuto Suzuki, Kyoto (JP); Katsuaki Takeuchi, Kyoto (JP); Mitsuru Tanemoto, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/746,198

(22) Filed: Jan. 17, 2020

(65) Prior Publication Data

US 2020/0262208 A1 Aug. 20, 2020

(30) Foreign Application Priority Data

Feb. 18, 2019 (JP) ..... JP2019-026404

(51) Int. Cl.
*B41J 2/175* (2006.01)

(52) U.S. Cl.
CPC ..... *B41J 2/17503* (2013.01); *B41J 2/175* (2013.01); *B41J 2/17509* (2013.01); *B41J 2/17566* (2013.01); *B41J 2002/17579* (2013.01)

(58) Field of Classification Search
CPC ..... B41J 2/17503; B41J 2/17566; B41J 2/17509; B41J 2/175; B41J 2002/17579
See application file for complete search history.

(56) References Cited

U.S. PATENT DOCUMENTS

2011/0310143 A1* 12/2011 Shmuel ..... B41J 2/175 347/7
2013/0286065 A1* 10/2013 Uetsuki ..... B41J 2/17553 347/7

FOREIGN PATENT DOCUMENTS

JP 4337330 B2 9/2009

* cited by examiner

*Primary Examiner* — Yaovi M Ameh

(74) *Attorney, Agent, or Firm* — McDermott Will & Emery LLP

(57) ABSTRACT

A printing apparatus comprises a main tank, an intermediate tank, and a control unit controlling an amount of the ink stored in the intermediate tank by a normal replenishing operation for increasing an ink remaining amount to a normal amount more than a first reference amount by feeding the ink from the main tank to the intermediate tank if the ink remaining amount falls below the first reference amount. The control unit controls the amount of the ink stored in the intermediate tank by an extraordinary replenishing operation for increasing the ink remaining amount to a second reference amount by feeding the ink from the main tank to the intermediate tank if the ink remaining amount falls below the second reference amount less than the first reference amount when the main tank held is exchanged.

5 Claims, 5 Drawing Sheets

PRINTING APPARATUS AND INK REPLENISHMENT METHOD

CROSS REFERENCE TO RELATED APPLICATION

The disclosure of Japanese Patent Application No. 2019-026404 filed on Feb. 18, 2019 including specification, drawings and claims is incorporated herein by reference in its entirety.

BACKGROUND OF THE INVENTION

1. Field of the Invention

This invention relates to a technique for supplying ink to an intermediate tank from a main tank detachably held.

2. Description of the Related Art

In a printing apparatus described in Publication of Japanese Patent No. 4337330, a recording head prints an image by an ink-jet method using ink supplied from an ink cartridge to a buffer tank. Further, if the ink in the buffer tank decreases, the ink is supplied from the ink cartridge to the buffer tank. Specifically, if a liquid level in the buffer tank falls to level L3, the ink is supplied from the ink cartridge to the buffer tank until the liquid level rises to level L1.

SUMMARY OF THE INVENTION

By the way, a main tank for storing ink such as an ink cartridge is exchanged as appropriate as the ink is consumed. At this time, if there is a large difference in characteristics (e.g. density) between the ink in the main tank before an exchange and the ink in the main tank after the exchange, the quality of an image to be printed drastically changes before and after the exchange of the main tank.

This invention was developed in view of the above problem and aims to enable a drastic change in the quality of an image before and after an exchange of a main tank to be suppressed in a printing technique for printing an image by discharging ink fed from the main tank to an intermediate tank by a printing head.

A printing apparatus according to the invention, comprises: a main tank that stores ink; a tank holder configured to detachably hold the main tank; an intermediate tank that stores the ink supplied from the main tank; a printing head configured to discharge the ink supplied from the intermediate tank; an ink driver configured to feed the ink from the main tank to the intermediate tank; an ink amount detector configured to detect an amount of the ink stored in the intermediate tank as an ink remaining amount; and a control unit configured to control the amount of the ink stored in the intermediate tank by a normal replenishing operation for increasing the ink remaining amount to a normal amount more than a first reference amount by feeding the ink from the main tank to the intermediate tank by the ink driver if the ink remaining amount falls below the first reference amount, and the control unit controls the amount of the ink stored in the intermediate tank by an extraordinary replenishing operation for increasing the ink remaining amount to a second reference amount by feeding the ink from the main tank to the intermediate tank by the ink driver if the ink remaining amount falls below the second reference amount less than the first reference amount when the main tank held by the tank holder is exchanged.

An ink replenishment method according to the invention, comprises: detecting an amount of ink stored in an intermediate tank that stores the ink to be supplied to a printing head that discharges the ink as an ink remaining amount, determining whether or not to exchange a main tank that stores the ink to be fed to the intermediate tank; performing a normal replenishing operation for increasing the ink remaining amount to a normal amount more than a first reference amount by feeding the ink from the main tank to the intermediate tank if the ink remaining amount falls below the first reference amount before an exchange of the main tank, and controlling the amount of the ink stored in the intermediate tank by an extraordinary replenishing operation for increasing the ink remaining amount to a second reference amount by feeding the ink from the main tank to the intermediate tank if the ink remaining amount falls below the second reference amount less than the first reference amount after the exchange of the main tank.

In the invention (printing apparatus, ink replenishment method) thus configured, the ink is replenished from the main tank to the intermediate tank by the normal replenishing operation for increasing the ink remaining amount to the normal amount more than the first reference amount when the ink remaining amount falls below the first reference amount in normal time before the exchange of the main tank. On the other hand, the ink is replenished from the main tank to the intermediate tank by the extraordinary replenishing operation for increasing the ink remaining amount to the second reference amount when the ink remaining amount falls below the second reference amount less than the first reference amount after the exchange of the main tank.

That is, after the exchange of the main tank, the ink is replenished from the main tank after the exchange to the intermediate tank in which the ink supplied from the main tank before the exchange remains. At this time, if a large amount of the ink is supplied from the main tank after the exchange, characteristics of the ink stored in the intermediate tank change at once and a drastic change in image quality may be caused. In contrast, in the invention, after the exchange of the main tank, the replenishment of the ink is stopped if the ink remaining amount in the intermediate tank increases to the second reference amount less than the first reference amount before the exchange of the main tank, whereby the amount of the ink supplied from the main tank after the exchange to the intermediate tank is suppressed. As a result, a drastic change in the quality of an image before and after the exchange of the main tank can be suppressed.

Incidentally, a technique for suppressing a drastic change in image quality before and after an exchange of the ink cartridge (main tank) is described also in Publication of Japanese Patent No. 4337330. However, the invention can exhibit a more advantageous effect by having a configuration different from that of Publication of Japanese Patent No. 4337330. This point is described in detail next.

In Publication of Japanese Patent No. 4337330, if the liquid level in the buffer tank falls to the level L3 in normal time (before the exchange of the cartridge), the ink is supplied from the ink cartridge to the buffer tank until the liquid level rises to the level L1 as described above. On the other hand, the ink is supplied to the buffer tank in a mode different from the one in normal time to suppress a drastic change in the characteristics of the ink in the buffer tank after the exchange of the ink cartridge. Specifically, if the liquid level falls to level L2 higher than the level L3, the ink is supplied from the ink cartridge to the buffer tank until the liquid level in the buffer tank rises to the level L1. That is, by supplying the ink from the ink cartridge to the buffer tank early before the liquid level falls to the level L3 in normal time to suppress the amount of new ink after the exchange supplied to the old ink before the exchange, a drastic change in the characteristics of the ink in the buffer tank is suppressed.

Incidentally, the ink cartridge is exchanged at an appropriate timing by a user. Thus, the ink cartridge is not necessarily promptly exchanged when the ink in the ink cartridge runs out. In contrast, the ink stored in the buffer tank decreases as printing is performed, and the liquid level in the buffer tank eventually falls to the level L2. Unless the ink cartridge is exchanged until this point of time, the ink cannot be supplied from the ink cartridge to the buffer tank. Thus, printing needs to be stopped. This is because a large amount of the new ink after the exchange is supplied to the old ink before the exchange if the ink is supplied to the level L1 after the ink in the buffer tank further decreases by continuing printing, whereby the characteristics of the ink in the buffer tank drastically change before and after the exchange of the ink cartridge.

However, this level L2 is set higher than the level L3 in normal time. That is, a time required for the liquid level in the buffer tank to fall to the level L2 after the ink in the ink cartridge runs out is relatively short. Thus, the ink cartridge needs to be promptly exchanged to avoid the stop of printing and a burden on the user has been great.

In contrast, in the invention, the ink is replenished from the main tank to the intermediate tank by increasing the ink remaining amount to the second reference amount if the ink remaining amount in the intermediate tank falls below the second reference amount less than the first reference amount in normal time after the exchange of the main tank (extraordinary replenishing operation). That is, the second reference amount that triggers the replenishment of the ink from the main tank to the intermediate tank is suppressed and a time required until the ink remaining amount in the intermediate tank decreases to the second reference amount after the ink in the main tank runs out can be ensured to be relatively long. As a result, the user can exchange the main tank with a time margin, and a burden on the user can be alleviated.

As described above, according to the invention, a drastic change in the quality of an image before and after an exchange of a main tank can be suppressed in a printing technique for printing an image by discharging ink fed from the main tank to an intermediate tank by a printing head.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
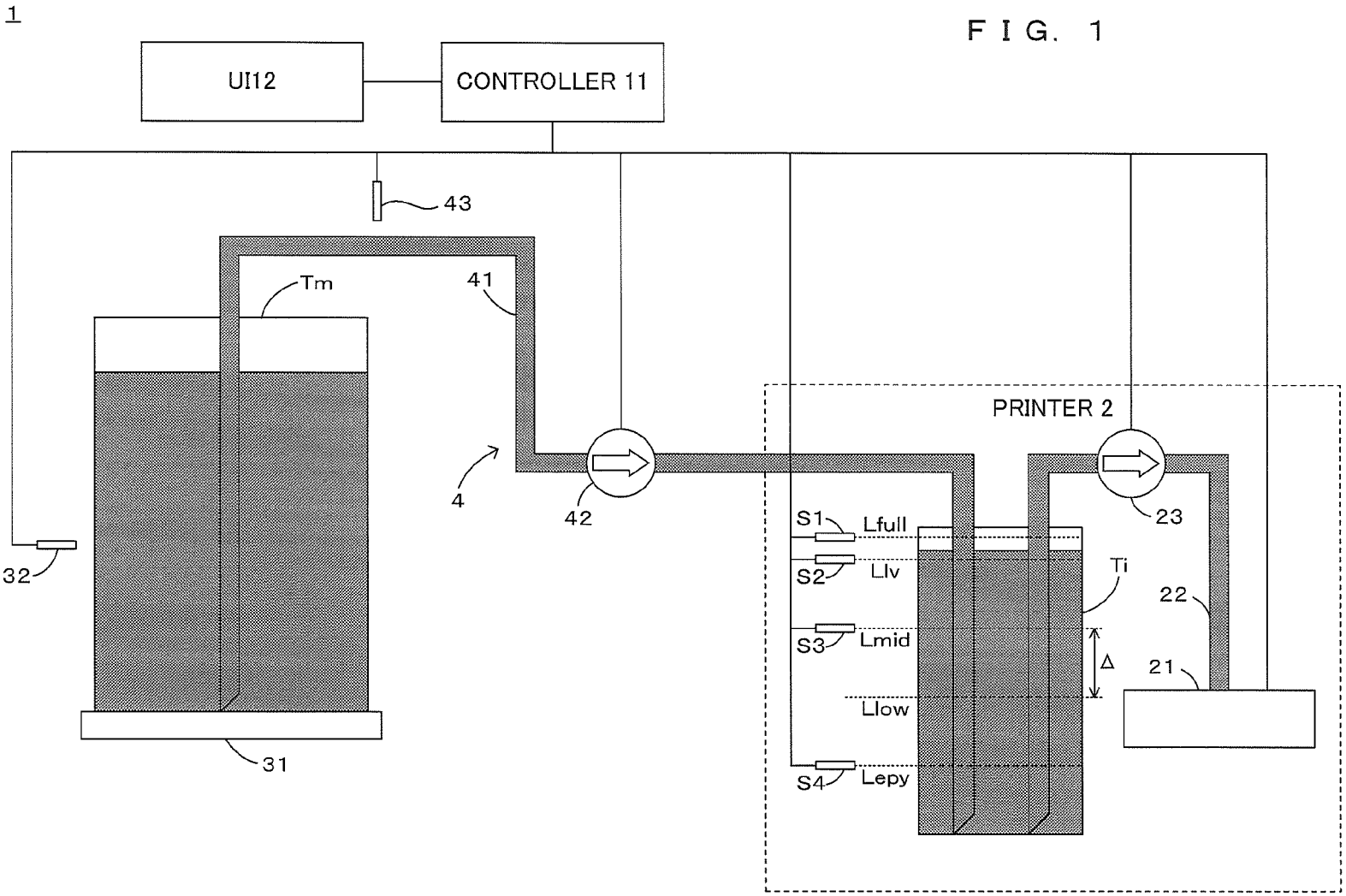
FIG. 1 is a diagram schematically showing an example of a printing apparatus according to the invention.

FIG. 1 is a diagram schematically showing an example of a printing apparatus according to the invention. In FIG. 1, a dot-hatched range indicates a range where ink is present. The printing apparatus 1 includes a controller 11 for integrally controlling the entire apparatus. The controller 11 is a processor composed of a CPU (Central Processing Unit), a RAM (Random Access memory) and the like. Further, the printing apparatus 1 includes a UI (User Interface) 2 to notify a user, for example, by means of sound, light or characters based on a command from the controller 11.

Further, the printing apparatus 1 includes a printer 2 capable of performing printing. The printer 2 includes a cylindrical intermediate tank Ti that stores ink, a printing head 21, a pipe 22 extending from the intermediate tank Ti to the printing head 21, and a pump 23 disposed in the pipe 22 between the intermediate tank Ti and the printing head 21. The pump 23 is, for example, a diaphragm pump and supplies the ink from the intermediate tank Ti to the printing head 21 via the pipe 22 by driving the ink in the pipe 22. The printing head 21 shoots the ink onto a printing medium such as paper or film by discharging the ink supplied from the intermediate tank Ti by the pump 23 by an ink-jet method, thereby printing an image. Note that the amount of the ink which is discharged by the printing head 21, the timing at which the printing head 21 discharges the ink and the supply of the ink by the pump 23 are controlled by the controller 11.

The amount of the ink stored in the intermediate tank Ti, i.e. an ink remaining amount, is controlled based on five liquid levels of Lfull, Llv, Lmid, Llow and Lepy. These liquid levels (i.e. heights of the liquid surfaces of the ink in the intermediate tank Ti) satisfy the following relationship:

$$Lfull > Llv > Lmid > Llow > Lepy.$$

In this example, Lmid is 75% of Llv, Llow is 50% of Llv, Lepy is 25% of Llv, and a ratio of these liquid levels is equivalent to a ratio of volumes (remaining amounts) of the ink stored up to the respective liquid levels. However, specific values of these liquid levels are not limited to those in this example.

Liquid level sensors S1, S2, S3 and S4 are respectively facing the four liquid levels Lfull, Llv, Lmid and Lepy, out of these liquid levels. Each of the liquid level sensors S1, S2, S3 and S4 is, for example, a capacitance sensor and detects whether or not the ink is present at the facing liquid level Lfull, Llv, Lmid, Lepy in the intermediate tank Ti. Specifically, the liquid level sensor S1, S2, S3, S4 outputs an ON-signal to the controller 11 if the ink is present at the facing liquid level Lfull, Llv, Lmid, Lepy, and outputs an OFF-signal to the controller 11 if the ink is not present. Thus, the controller 11 can confirm the ink remaining amount in the intermediate tank Ti based on the outputs of the liquid level sensors S1, S2, S3 and S4. Further, the controller 11 can confirm a fall of the ink liquid level in the intermediate tank Ti to the liquid level Llow based on that the amount of the ink fed by the pump 23 has reached a predetermined amount after the output of the liquid level sensor S3 was switched from ON to OFF.

Further, the printing apparatus 1 includes a tank holder 31 that detachably holds a main tank Tm having a larger capacity than the intermediate tank Ti and storing the ink, and a tank sensor 32 that detects the presence or absence of the main tank Tm mounted to the tank holder 31. The tank sensor 32 outputs an ON-signal to the controller 11 if the main tank Tm is mounted to the tank holder 31, and outputs an OFF-signal to the controller 11 if the main tank Tm is not mounted to the tank holder 31.

Further, the printing apparatus 1 includes a liquid feeding unit 4 that feeds the ink from the main tank Tm held by the tank holder 31 to the intermediate tank Ti of the printer 2. The liquid feeding unit 4 includes a pipe 41 extending from the main tank Tm to the intermediate tank Ti of the printer 2 and a pump 42 disposed in the pipe 41 between the main tank Tm and the intermediate tank Ti. The pump 42 is, for example, a diaphragm pump and feeds the ink from the main tank Tm to the intermediate tank Ti via the pipe 41 by driving the ink in the pipe 41. The supply of the ink by the pump 42 is controlled by the controller 11.

An empty sensor 43 faces to the pipe 41. This empty sensor 43 is, for example, a capacitance sensor and detects whether or not the ink is present in the pipe 41 to which it faces. Specifically, the empty sensor 43 outputs an ON-signal to the controller 11 if the ink is present in the pipe 41, and outputs an OFF-signal to the controller 11 if the ink is not present in the pipe 41. Thus, the controller 11 can confirm that the ink in the main tank Tm has been used up to empty the main tank Tm based on a switch of the output of the empty sensor 43 from the ON-signal to the OFF-signal.

The controller 11 performs an operation described below by controlling the pumps 42 and 23 and the UI 12 based on detection results of the tank sensor 32, the empty sensor 43, the liquid level sensors S1 to S4 and the like.

Figure 2:
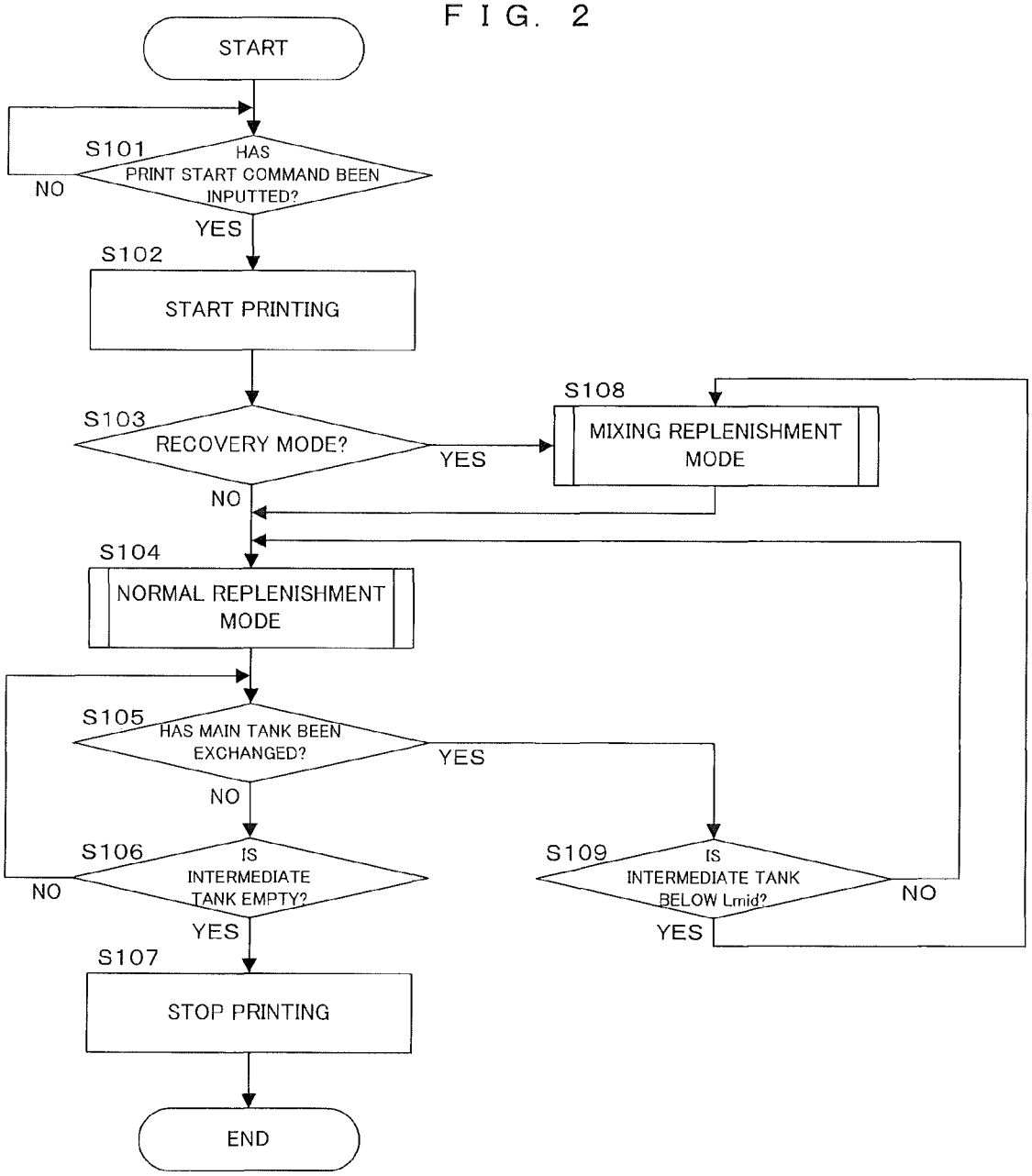
FIG. 2 is a flow chart showing an example of the operation performed in the printing apparatus of FIG. 1.

FIG. 2 is a flow chart showing an example of the operation performed in the printing apparatus of FIG. 1. Each step of this flow chart is performed by the control of the controller 11. In Step S101, the controller 11 determines whether or not a user has input a print start command via the UI 12. If the input of the print start command is confirmed ("YES" in Step S101), the pump 23 is started, the supply of the ink from the intermediate tank Ti to the printing head 21 is started and printing is started (Step S102). In this way, the printing head 21 can discharge the ink to print an image on an unillustrated printing medium.

Subsequently, the controller 11 determines whether or not a state of the printing apparatus 1 having started printing in Step S102 is a recovery mode (Step S103). Specifically, if a predetermined time has elapsed before this printing is started in Step S102 after the previous printing is finished, the state of the printing apparatus 1 is determined to be the recovery mode ("YES" in Step S103) and the ink is replenished from the main tank Tm to the intermediate tank Ti by a mixing replenishment mode of Step S108. Note that the mixing replenishment mode is described in detail later using FIG. 4. On the other hand, unless the predetermined time has elapsed before this printing is started in Step S102 after the previous printing is finished, the state of the printing apparatus 1 is determined not to be the recovery mode ("NO" in Step S103), and the supply of the ink from the main tank Tm to the intermediate tank Ti after the start of the printing is performed by a normal replenishment mode of Step S104.

Figure 3:
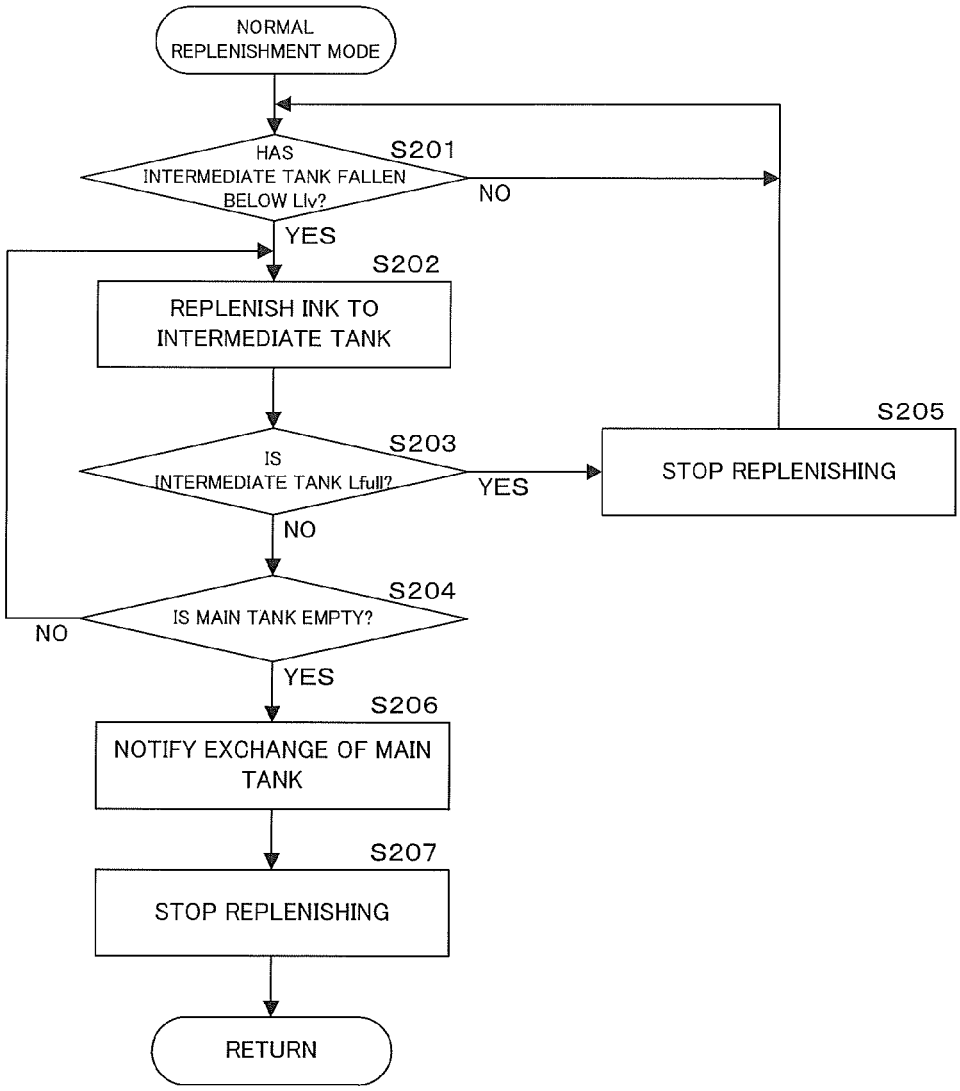
FIG. 3 is a flow chart showing an example of the normal replenishment mode.

FIG. 3 is a flow chart showing an example of the normal replenishment mode. Each step of this flow chart is performed by the control of the controller 11. In Step S201, whether or not the ink liquid level in the intermediate tank Ti has fallen below the liquid level Llv is determined based on the output of the liquid level sensor S2 facing the liquid level Llv. If the output of the liquid level sensor S2 is switched from the ON-signal to the OFF-signal, the ink liquid level in the intermediate tank Ti is determined to have fallen below the liquid level Llv ("YES" in Step S201), the drive of the pump 42 is started and the ink is replenished from the main tank Tm to the intermediate tank Ti (Step S202).

In Step S203, whether or not the ink liquid level in the intermediate tank Ti has risen to the liquid level Lfull based on the output of the liquid level sensor S1 facing the liquid level Lfull. If the output of the liquid level sensor S1 is an OFF-signal and the ink in the intermediate tank Ti has not reached the liquid level Lfull ("NO" in Step S203), whether or not the main tank Tm has been emptied is determined based on the output of the empty sensor 43 (Step S204). If the main tank Tm is not empty ("NO" in Step S204), return is made to Step S202 and Steps S202 to S204 are repeated until "YES" is determined in either Step S203 or Step S204.

If the output of the liquid level sensor S1 is switched to the ON-signal and the ink liquid level in the intermediate tank Ti has reached the liquid level Lfull in Step S203 ("YES" in Step S203), the replenishment of the ink from the main tank Tm to the intermediate tank Ti is stopped by stopping the pump 42 (Step S205). Then, return is made to Step S201 and Steps S201 to S205 are repeated every time the ink liquid level in the intermediate tank Ti falls below the liquid level Llv.

If the main tank Tm is emptied without the ink liquid level in the intermediate tank Ti reaching the liquid level Lfull ("YES" in Step S204), the UI 12 notifies to the user to exchange the main tank Tm (Step S206). If the pump 42 is stopped and the replenishment of the ink from the main tank Tm to the intermediate tank Ti is stopped in Step S207, Step S105 of FIG. 2 follows.

In Step S105, whether or not the main tank Tm has been exchanged is determined based on the output of the tank sensor 32. Unless the exchange of the main tank Tm is confirmed ("NO" in Step S105), whether or not the ink liquid level in the intermediate tank Ti has fallen below the liquid level Lepy is determined based on the output of the liquid level sensor S4 facing the liquid level Lepy (Step S106). If the output of the liquid level sensor S4 is an OFF-signal, it is determined that the ink liquid level in the intermediate tank Ti has fallen below the liquid level Lepy to empty the intermediate tank Ti (i.e. "YES" is determined in Step S106) and Step S107 follows. In Step S107, the supply of the ink from the intermediate tank Ti to the printing head 21 is stopped and printing is stopped by stopping the pump 23. That is, if the intermediate tank Ti is emptied before the exchange of the main tank Tm, printing is stopped.

Note that a specific method for detecting the emptiness of the intermediate tank Ti can be changed as appropriate. For example, an ink supply amount from the intermediate tank Ti to the printing head 21 may be calculated based on an operation time of the pump P23 and the emptiness of the intermediate tank Ti may be detected from this ink supply amount.

On the other hand, if the exchange of the main tank Tm is confirmed before the intermediate tank Ti is emptied ("YES" in Step S105), whether or not the ink liquid level in the intermediate tank Ti is below the liquid level Lmid is determined based on the output of the liquid level sensor S3 facing the liquid level Lmid (Step S109). If the ink liquid level in the intermediate tank Ti is not below the liquid level Lmid ("NO" in Step S109), return is made to Step S104 and the replenishment of the ink from the main tank Tm to the intermediate tank Ti is performed by the normal replenishment mode after the exchange of the main tank Tm. On the other hand, if the ink liquid level in the intermediate tank Ti is below the liquid level Lmid ("YES" in Step S109), the replenishment of the ink from the main tank Tm to the intermediate tank Ti is performed by the mixing replenishment mode after the exchange of the main tank Tm.

Figure 4:
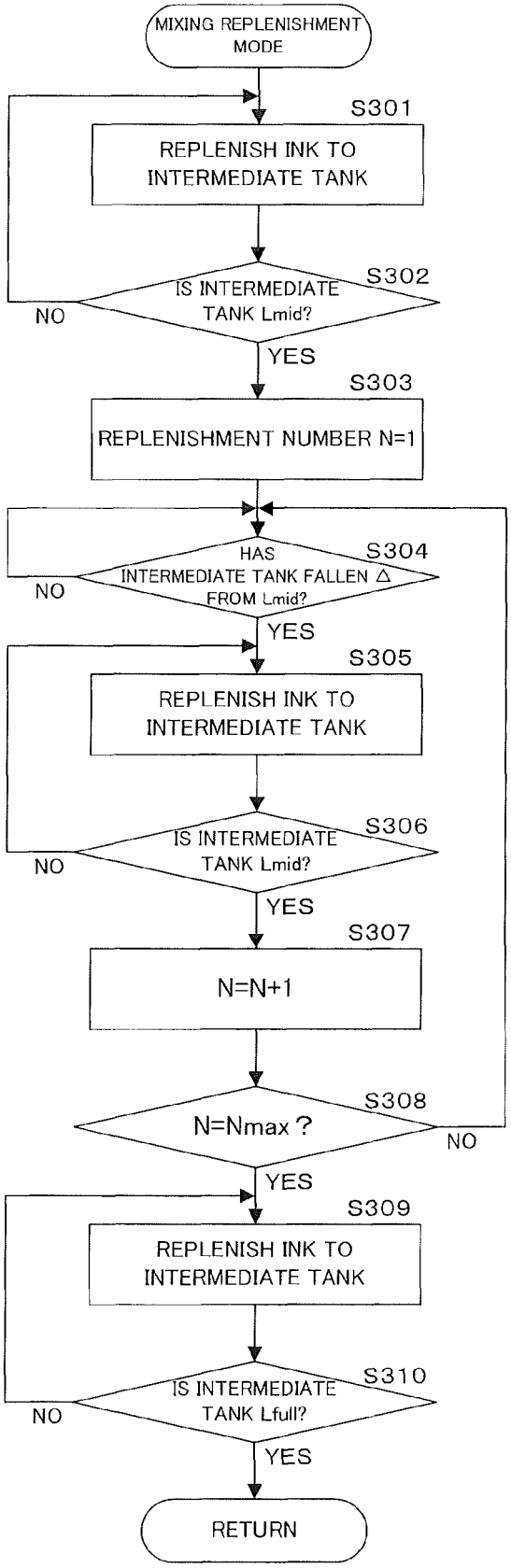
FIG. 4 is a flow chart showing an example of the mixing replenishment mode.

FIG. 4 is a flow chart showing an example of the mixing replenishment mode. Each step of this flow chart is performed by the control of the controller 11. In Step S301, the drive of the pump 42 is started to replenish the ink from the main tank Tm to the intermediate tank Ti. In Step S302, whether or not the ink liquid level in the intermediate tank Ti has risen to the liquid level Lmid is determined based on the output of the liquid level sensor S3 facing the liquid level Lmid. If the output of the liquid level sensor S3 is switched from the OFF-signal to the ON-signal, it is determined that the ink liquid level in the intermediate tank Ti has risen to the liquid level Lmid (i.e. "YES" is determined in Step S302) and the replenishment of the ink from the main tank Tm to the intermediate tank Ti is stopped by stopping the pump 42.

If the first replenishment to the intermediate tank Ti is completed in this way after the exchange of the main tank Tm, a replenishment number N is set to "1" in Step S303. This replenishment number N represents a number of times at which the ink has been replenished from the main tank Tm to the intermediate tank Ti after the exchange of the main tank Tm.

In Step S304, whether or not the ink liquid level in the intermediate tank Ti has fallen from the liquid level Lmid by a predetermined amount Δ is determined based on the amount of the ink supplied from the intermediate tank Ti to the printing head 21 by the pump 23. This predetermined amount Δ is equivalent to a difference between the liquid level Lmid and the liquid level Llow. If it is determined that the ink liquid level in the intermediate tank Ti had fallen from the liquid level Lmid by the predetermined amount Δ ("YES" in Step S304), Step S305 follows.

In Step S305, the drive of the pump 42 is started to replenish the ink from the main tank Tm to the intermediate tank Ti. In Step S306, whether or not the ink liquid level in the intermediate tank Ti has risen to the liquid level Lmid is determined based on the output of the liquid level sensor S3 facing the liquid level Lmid. If the output of the liquid level sensor S3 is switched from the OFF-signal to the ON-signal, it is determined that the ink liquid level in the intermediate tank Ti has risen to the liquid level Lmid (i.e. "YES" is determined in Step S306) and the replenishment of the ink from the main tank Tm to the intermediate tank Ti is stopped by stopping the pump 42.

The replenishment number N is incremented (i.e. increased by 1) in Step S307, and whether or not the replenishment number N has reached a maximum replenishment number Nmax is determined in Step S308. The maximum replenishment number Nmax is a value equal to or greater than 2 and may be set in a memory of the controller 11 such as when the printing apparatus 1 is shipped or may be set by the user by means of the UI 12. In the latter case, the user can set an arbitrary maximum replenishment number Nmax. If the replenishment number N is less than the maximum replenishment number Nmax, return is made to Step S304 and Steps S304 to S308 are repeated until the replenishment number N reaches the maximum replenishment number Nmax (i.e. "YES" is determined in Step S308).

That is, in the normal replenishment mode shown in FIG. 3, the replenishment of the ink to the intermediate tank Ti is performed by causing the ink liquid level in the intermediate tank Ti to rise to the liquid level Lfull if the ink liquid level in the intermediate tank Ti falls below the liquid level Llv. In contrast, in the mixing replenishment mode shown in FIG. 4, the first Nmax replenishments of the ink to the intermediate tank Ti after the exchange of the main tank Tm are performed by causing the ink liquid level in the intermediate tank Ti to rise to the liquid level Lmid if the ink liquid level in the intermediate tank Ti falls from the liquid level Lmid by the predetermined amount Δ.

If the replenishment of the ink to the intermediate tank Ti is performed Nmax times ("YES" in Step S308), the pump 42 is started to start the replenishment of the ink from the main tank Tm to the intermediate tank Ti (Step S309). In Step S310, whether or not the ink liquid level in the intermediate tank Ti has risen to the liquid level Lfull is determined based on the output of the liquid level sensor S1 facing the liquid level Lfull. If the output of the liquid level sensor S1 is switched to the ON-signal and the ink in the intermediate tank Ti reaches the liquid level Lfull ("YES" in Step S310), the replenishment of the ink from the main tank Tm to the intermediate tank Ti is stopped by stopping the pump 42 and return is made to Step S104 of FIG. 2. The replenishment of the ink to the intermediate tank Ti thereafter is performed in the normal replenishment mode.

In the embodiment described above, in normal time before the exchange of the main tank Tm, the ink is replenished from the main tank Tm to the intermediate tank Ti by a normal replenishing operation (Steps S201 to S205) for causing the ink liquid level to rise to the liquid level Lfull (normal amount) higher than the liquid level Llv when the ink liquid level (i.e. ink remaining amount) in the intermediate tank Ti falls below the liquid level Llv (first reference amount). On the other hand, after the exchange of the main tank Tm, the ink is replenished from the main tank Tm to the intermediate tank Ti by an extraordinary replenishing operation (Steps S301 to S302, Steps S304 to S306) for causing the ink liquid level to rise to the liquid level Lmid when the ink liquid level in the intermediate tank Ti falls below the liquid level Lmid (second reference amount) lower than the liquid level Llv.

That is, after the exchange of the main tank Tm, the ink is replenished from the main tank Tm after the exchange to the intermediate tank Ti in which the ink supplied from the main tank Tm before the exchange remains. At this time, if a large amount of the ink is supplied from the main tank Tm after the exchange, characteristics of the ink stored in the intermediate tank T change at once to cause a drastic change in image quality. In contrast, in this embodiment, the replenishment of the ink is stopped if the ink liquid level in the intermediate tank Ti rises to the liquid level Lmid lower than the liquid level Llv after the exchange of the main tank Tm. In this way, the amount of the ink supplied from the main tank Tm to the intermediate tank Ti after the exchange is suppressed. As a result, a drastic change in the equality of an image before and after the exchange of the main tank Tm can be suppressed.

Particularly, in this embodiment, the liquid level Lmid, which triggers the first replenishment of the ink from the main tank Tm to the intermediate tank Ti after the exchange of the main tank Tm, is suppressed low as compared to the liquid level Llv which triggers the ink replenishment in normal time. Thus, a time required until the liquid level in the intermediate tank Ti falls to the liquid level Lmid after the ink in the main tank Tm runs out is ensured to be relatively long. As a result, the user can exchange the main tank Tm with a time margin, and a burden on the user can be alleviated.

Further, if the liquid level in the intermediate tank Ti is not below the liquid level Lmid ("NO" in Step S109) when the main tank Tm is exchanged, the amount of the ink stored in the intermediate tank Ti is controlled by the normal replenishing operation (Steps S201 to S205). On the other hand, if the liquid level in the intermediate tank Ti is below the liquid level Lmid ("YES" in Step S109) when the main tank Tm is exchanged, the amount of the ink stored in the intermediate tank Ti is controlled by the extraordinary replenishing operation (Steps S301 to S302, Steps S304 to S306). That is, if the ink liquid level in the intermediate tank Ti when the main tank Tm is exchanged is not below the liquid level Lmid and a large amount of the ink supplied from the main tank Tm before the exchange remains in the intermediate tank Ti, drastic changes of the characteristics of the ink in the intermediate tank Ti are not caused even if the ink is supplied from the main tank Tm after the exchange to the intermediate tank Ti by the normal replenishing operation (Steps S201 to S205). Thus, a drastic change in the quality of an image before and after the exchange of the main tank Tm can be suppressed by replenishing the ink by the normal replenishing operation (Steps S201 to S205). On the other hand, if the ink liquid level in the intermediate tank Ti when the main tank Tm is exchanged is below the liquid level Lmid, a drastic change in the quality of an image before and after the exchange of the main tank Tm can be suppressed for the aforementioned reason by replenishing the ink by the extraordinary replenishing operation (Steps S301 to S302, Steps S304 to S306).

Further, after the extraordinary replenishing operation (Steps S301 to S302, Steps S304 to S306) is performed Nmax times (a plurality of number of times), the amount of the ink stored in the intermediate tank Ti is controlled by the normal replenishing operation (Steps S201 to S205). In such a configuration, the ink supplied from the main tank Tm after the exchange to the intermediate tank Ti can be gradually mixed with the ink supplied from the main tank Tm before the exchange to the intermediate tank Ti. Thus, characteristic changes of the ink stored in the intermediate tank Ti can be moderated and a drastic change in the quality of an image before and after the exchange of the main tank Tm can be suppressed.

Further, the second or subsequent extraordinary replenishing operation (Steps S304 to S306) is triggered by a fall of the ink remaining amount below the liquid level Llow (third reference amount) lower than the liquid level Lmid. In this way, the ink supplied from the main tank Tm after the exchange to the intermediate tank Ti can be gradually mixed with the ink supplied from the main tank Tm before the exchange to the intermediate tank Ti.

Furthermore, if it is determined that the intermediate tank Ti is emptied (i.e. the liquid level falls below the liquid level Lepy) ("YES" in Step S106), a series of processes are finished after printing is stopped (Step S107). In the case of replenishing the ink from the main tank Tm after the exchange to the emptied intermediate tank Ti, a large amount of the ink is replenished from the main tank Tm after the exchange to the intermediate tank Ti. If this occurs, a mixing ratio of the ink replenished from the main tank Tm after the exchange becomes higher and the characteristics of the ink stored in the intermediate tank Ti may drastically change. In this embodiment, to prevent this, printing is stopped after the intermediate tank Ti is emptied.

In the embodiment described above, the printing apparatus 1 corresponds to an example of a "printing apparatus" of the invention, the printing head 21 corresponds to an example of a "printing head" of the invention, the tank holder 31 corresponds to an example of a "tank holder" of the invention, the pump 42 corresponds to an example of an "ink driver" of the invention, the main tank Tm corresponds to an example of a "main tank" of the invention, the intermediate tank Ti corresponds to an example of an "intermediate tank" of the invention, the liquid level sensors S1 to S4 and the controller 11 (for monitoring a liquid feeding amount of the pump 23) correspond to an example of an "ink amount detector" of the invention, the controller 11 corresponds to an example of a "control unit" of the invention, Steps S201 to S205 correspond to an example of a "normal replenishing operation" of the invention, Steps S301 to S302 and Steps S304 to S306 correspond to an example of an "extraordinary replenishing operation" of the invention, the liquid level Lfull corresponds to an example of a "normal amount" of the invention, the liquid level Llv corresponds to an example of a "first reference amount" of the invention, the liquid level Lmid corresponds to an example of a "second reference amount" of the invention and the liquid level Llow corresponds to an example of a "third reference amount" of the invention.

Note that the invention is not limited to the above embodiment and various changes other than the aforementioned ones can be made without departing from the gist of the invention. For examples, the ratio of the liquid levels Lfull, Llv, Lmid, Llow and Lepy can be changed as appropriate as described above.

On this occasion, the liquid level Lmid (second reference amount) may be set equal to or more than 65% and equal to or less than 85% of the liquid level Llv (first reference amount). In this way, the amount of the ink supplied from the main tank Tm after the exchange to the intermediate tank Ti can be properly suppressed and a drastic change in the quality of an image before and after the exchange of the main tank Tm can be suppressed.

Figure 5:
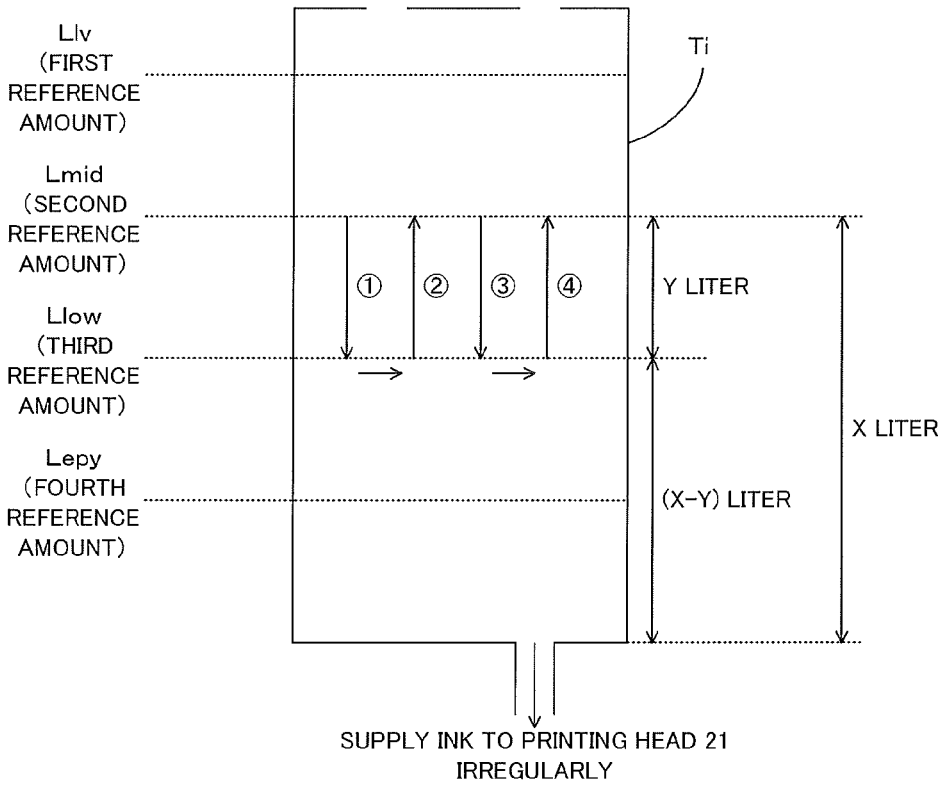
FIG. 5 is a diagram showing a change of the liquid level in the mixing replenishment mode.

Here, how to set the liquid level Llow (third reference amount) is described. A reference diagram of FIG. 5 is referred to. FIG. 5 is a diagram showing a change of the liquid level in the mixing replenishment mode.

When the mixing replenishment mode is started, the amount of the ink stored in the intermediate tank Ti is an amount (assumed to be x liters) equivalent to the liquid level Lmid (second reference amount). Further, the amount of the ink supplied to the intermediate tank Ti during one replenishment period is an amount equivalent to a difference (assumed to be y liters) between the liquid level Lmid (second reference amount) and the liquid level Llow (third reference amount) if the supply of the ink to the printing head 21 during the same period is ignored.

Accordingly, if x liters are divided by y liters, an ink replenishment number necessary to replace all the ink stored in the intermediate tank Ti at the start of the mixing replenishment mode by new ink (ink replenished from the main tank Tm after the exchange) can be obtained.

The ink replenishment number capable of gradually replacing the ink in the intermediate tank Ti by the new ink is, for example, two to four times. Accordingly, if the y liters are set equal to or more than 25% and equal to or less than 50% of x liters, all the ink in the intermediate tank Ti can be replaced by the new ink by two to four ink replenishments. If the third reference amount is set in this way, the ink stored in the intermediate tank Ti at the start of the mixing replenishment mode can be gradually replaced by the new ink.

The invention can be applied to printing techniques in general for printing using ink supplied from a detachably held main tank to an intermediate tank.

As describe above, the printing apparatus may be configured so that the control unit controls the amount of the ink stored in the intermediate tank by the normal replenishing operation if the ink remaining amount is not less than the second reference amount and controls the amount of the ink stored in the intermediate tank by the extraordinary replenishing operation if the ink remaining amount is less than the second reference amount when the main tank is exchanged. That is, if the ink remaining amount in the intermediate tank when the main tank is exchanged is not less than the second reference amount and a large amount of the ink supplied from the main tank before the exchange remains in the intermediate tank, a drastic change in the characteristics of the ink in the intermediate tank is not caused even if the ink is supplied from the main tank after the exchange to the intermediate tank by the normal replenishing operation. Accordingly, a drastic change in the quality of an image before and after the exchange of the main tank can be suppressed by replenishing the ink by the normal replenishing operation. On the other hand, if the ink remaining amount in the intermediate tank when the main tank is exchanged is less than the second reference amount, a drastic change in the quality of an image before and after the exchange of the main tank can be suppressed by replenishing the ink by the extraordinary replenishing operation for the aforementioned reason.

The printing apparatus may be configured so that the second reference amount is 65% or more and 85% or less of the first reference amount. By setting the second reference amount in this way, a drastic change in the quality of an image before and after the exchange of the main tank can be suppressed by properly suppressing the amount of the ink supplied from the main tank after the exchange to the intermediate tank.

The printing apparatus may be configured so that the control unit controls the amount of the ink stored in the intermediate tank by the normal replenishing operation after the extraordinary replenishing operation is performed a plurality of number of times. In such a configuration, the ink supplied from the main tank after the exchange to the intermediate tank can be gradually mixed with the ink supplied to the intermediate tank from the main tank before the exchange, characteristic changes of the ink stored in the intermediate tank can be moderated, and a drastic change in the quality of an image before and after the exchange of the main tank can be suppressed.

The printing apparatus may be configured so that the control unit performs the second and subsequent ones of the extraordinary replenishing operation, triggered by a fall of the ink remaining amount below a third reference amount less than the second reference amount. This enables the ink supplied from the main tank after the exchange to the intermediate tank to be gradually mixed with the ink supplied to the intermediate tank from the main tank before the exchange.

The printing apparatus may be configured so that the third reference amount is such a value that a value obtained by dividing a difference between the second reference amount and the third reference amount by the second reference amount is 25% or more and 50% or less.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A printing apparatus, comprising:

a main tank that stores ink;

a tank holder configured to detachably hold the main tank;

an intermediate tank that stores the ink supplied from the main tank;

a printing head configured to discharge the ink supplied from the intermediate tank;

an ink driver configured to feed the ink from the main tank to the intermediate tank;

an ink amount detector configured to detect an amount of the ink stored in the intermediate tank as an ink remaining amount; and a control unit configured to:

control the amount of the ink stored in the intermediate tank by a normal replenishing operation for increasing the ink remaining amount to a normal amount more than a first reference amount by feeding the ink from the main tank to the intermediate tank by the ink driver if the ink remaining amount falls below the first reference amount, and control the amount of the ink stored in the intermediate tank by an extraordinary replenishing operation for increasing the ink remaining amount to a second reference amount by feeding the ink from the main tank to the intermediate tank by the ink driver if the ink remaining amount falls below the second reference amount less than the first reference amount when the main tank held by the tank holder is exchanged, wherein the control unit controls the amount of the ink stored in the intermediate tank by the normal replenishing operation after the extraordinary replenishing operation is performed a plurality of number of times, and wherein the control unit performs second and subsequent ones of the extraordinary replenishing operation, triggered by a fall of the ink remaining amount below a third reference amount less than the second reference amount.

2. The printing apparatus according to claim 1, wherein the control unit controls the amount of the ink stored in the intermediate tank by the normal replenishing operation if the ink remaining amount is not less than the second reference amount and controls the amount of the ink stored in the intermediate tank by the extraordinary replenishing operation if the ink remaining amount is less than the second reference amount when the main tank is exchanged.

3. The printing apparatus according to claim 1, wherein the second reference amount is 65% or more and 85% or less of the first reference amount.

4. The printing apparatus according to claim 1, wherein the third reference amount is such a value that a value obtained by dividing a difference between the second reference amount and the third reference amount by the second reference amount is 25% or more and 50% or less.

5. An ink replenishment method, comprising:

detecting an amount of ink stored in an intermediate tank that stores the ink to be supplied to a printing head that discharges the ink as an ink remaining amount, determining whether or not to exchange a main tank that stores the ink to be fed to the intermediate tank;

performing a normal replenishing operation for increasing the ink remaining amount to a normal amount more than a first reference amount by feeding the ink from the main tank to the intermediate tank if the ink remaining amount falls below the first reference amount before an exchange of the main tank, and controlling the amount of the ink stored in the intermediate tank by an extraordinary replenishing operation for increasing the ink remaining amount to a second reference amount by feeding the ink from the main tank to the intermediate tank if the ink remaining amount falls below the second reference amount less than the first reference amount after the exchange of the main tank, wherein the controlling the amount of the ink includes controlling the amount of the ink stored in the intermediate tank by the normal replenishing operation after the extraordinary replenishing operation is performed a plurality of number of times, and wherein the controlling the amount of the ink further includes performing second and subsequent ones of the extraordinary replenishing operation, triggered by a fall of the ink remaining amount below a third reference amount less than the second reference amount.

* * * * *